US005503920A

United States Patent [19]

Alkire et al.

[11] Patent Number: 5,503,920

[45] Date of Patent: Apr. 2, 1996

[54] PROCESS FOR IMPROVING PARTING STRENGTH OF FIBERGLASS INSULATION

[75] Inventors: Roberta L. Alkire, Westerville; Michael E. Evans, Granville; William S. Miller, Newark, all of Ohio

[73] Assignee: Owens-Corning Fiberglass Technology, Inc., Summit, Ill.

[21] Appl. No.: 173,222

[22] Filed: Dec. 27, 1993

[51] Int. Cl.[6] ..... D04H 1/58

[52] U.S. Cl. ..... 428/288; 428/289; 264/103; 264/119; 427/380; 427/381

[58] Field of Search ..... 428/288, 290, 428/289; 264/103, 119; 427/380, 381

[56] References Cited

U.S. PATENT DOCUMENTS

| | | | |
|---|---|---|---|
| 4,828,926 | 5/1989 | Lalancette | 428/457 |
| 5,223,336 | 6/1993 | Griffith et al. | 428/285 |

*Primary Examiner*—Christopher W. Raimund
*Attorney, Agent, or Firm*—C. Michael Gegenheimer; Ted C. Gillespie

[57] ABSTRACT

Fiberglass insulation having improved parting strength is prepared by forming a fiberglass mat, applying an aqueous acid aluminum phosphate binder, curing the binder, and autoclaving the resultant insulation batt.

15 Claims, No Drawings

PROCESS FOR IMPROVING PARTING STRENGTH OF FIBERGLASS INSULATION

FIELD OF THE INVENTION

This invention relates generally to a process for improving the parting strength of fiberglass insulation. More particularly, the invention is directed to a process for coating glass fibers with an amorphous aluminum phosphate polymer and thereafter autoclaving the polymer-coated glass fibers to increase the parting strength of the resultant fiberglass batt; and to the fiberglass products made thereby.

BACKGROUND OF THE INVENTION

High and low density fibrous glass insulation products generally comprise matted glass fibers bonded together by an inorganic or organic binder. Molten streams of glass are drawn into fibers of random lengths and blown into a forming chamber where they are randomly deposited as a mat onto a traveling conveyor. The fibers, while in transit in the forming chamber and while still hot from the drawing operation, are sprayed with an aqueous binder. The residual heat from the glass fibers and the flow of air through the fibrous mat during the forming operation are generally sufficient to volatilize a majority of the water from the binder, thereby leaving the remaining components of the binder on the fibers as a viscous or semi-viscous high-solids liquid. The coated fibrous mat is then transferred by a conveyor to a curing oven where heated air is blown through the mat to cure the binder and rigidly bond the glass fibers together. Depending upon the vertical distance between the upper and lower flights within the curing oven, a high-density or low-density insulation product may be produced.

U.S. Pat. No. 5,223,336 to Griffith et al. discloses a glass fiber insulation product made by applying an aqueous acid aluminum phosphate binder to glass fibers and thereafter curing the binder by applying heat and removing water, to form an insulation product comprising glass fiber coated with an amorphous aluminum phosphate polymer.

The parting strength of fiberglass insulation is an important characteristic when considering the installation practices used for such products. Frequently, fiberglass batts are laid on a horizontal surface and pulled from one end, to properly position the insulation. Insulation products having poor parting strengths become deformed when pulled from an end, thereby causing a decrease in R-value at the end region of the batts.

It would be desirable to prepare fiberglass insulation products having improved parting strengths.

SUMMARY OF THE INVENTION

Accordant with the present invention, a process for preparing fiberglass insulation having improved parting strength surprisingly has been discovered. The process comprises:

forming a mat of glass fibers;

applying to the glass fibers an aqueous acid aluminum phosphate;

curing the aqueous acid aluminum phosphate to form an amorphous aluminum phosphate polymer; and autoclaving the polymer-coated glass fibers The invention further contemplates fiberglass insulation prepared by the novel process.

The process of the present invention is particularly useful for improving the strength of thermal and acoustical insulation products.

DETAILED DESCRIPTION OF THE PREFERRED EMBODIMENT

A mat of glass fibers may be formed by any conventional method. Preferably, the glass fibers are generated by a rotary extrusion process and gathered in a moving forming section to form the fiberglass mat. Molten glass is introduced to a rotating spinner having a cylindrically shaped side wall including a plurality of orifices. The molten glass is extruded through the orifices by the centrifugal force provided by the rotating spinner, to form fibers. The glass passing through the orifices is maintained in a plastic, attenuable condition by heat supplied by a plurality of adjacent burners. A high pressure annular blower which surrounds the spinner attenuates the fibers and forces them downwardly into a moving forming chamber where the fibers accumulate to form a mat of fiberglass. By the terms "fiberglass" and "glass fibers" as they are used herein are meant fibers of glass, slag, or other mineral material. The glass fibers typically have diameters from about 2 to about 12 microns and have lengths from about ¼ inch to about 3 inches. Preferably, the glass fibers range in diameter from about 3 to about 8 microns, and have lengths from about ½ inch to about 1½ inch. The glass fibers are deposited onto a perforated, endless forming conveyor within a forming chamber.

Binder is applied to the glass fibers as they are being formed by means of spray applicators so as to result in a distribution of the binder throughout the formed mat of fibrous glass. The glass fibers, having the uncured binder adhered thereto, are gathered and formed into a mat on the endless conveyor within the forming chamber with the aid of a vacuum drawn through the mat from below the forming conveyor. The residual heat contained in the glass fibers as well as the air flow through the mat causes a majority of the water to volatilize from the coated mat before it exits the forming chamber. Methods for forming glass fibers into a mat are more fully set forth in U.S. Pat. No. 4,917,715 which is incorporated herein in its entirety by reference thereto.

The binder coated fiberglass mat is then conveyed to and through a curing oven where heated air is passed through the mat to cure the binder. Moving flights above and below the mat compress the mat, to give the resultant cured fiberglass batt a predetermined thickness and surface finish. From this point, the cured batts will be autoclaved as explained more fully hereinafter.

The binder of the present invention is an aqueous acid aluminum phosphate, comprising a mixture of aluminum oxide, ortho-phosphoric acid, and water, in a molar ratio for $Al_2O_3$ to $P_2O_5$ of less than about 1, and preferably in the range from about 0.5 to about 0.25. Typically, the aluminum oxide is added to the water/phosphoric acid mixture which has been heated to a temperature above about 100° C. A clear viscous solution is formed, which can then be diluted with additional water to prepare a binder which may be sprayed onto the glass fibers as explained hereinabove. Methods for preparing the binder according to the present invention are more fully set forth in U.S. Pat. No. 5,223,336 which is incorporated herein in its entirety by reference thereto.

The coated glass fibers are conveyed through a curing oven maintained at a temperature from about 315° C. to about 425° C. Preferably, the curing oven is maintained at a temperature from about 375° C. to about 400° C. Generally, the coated fiberglass mat resides within the curing oven for a period of time from about ½ minute to about 3 minutes. Preferably, the residence time is from about ¾ minute to 1½ minute. Under these conditions, the aqueous acid aluminum phosphate polymerizes or cures to form a water insoluble, amorphous aluminum phosphate polymer. The fibrous glass having a cured, rigid binder polymer matrix emerges from the curing oven in the form of a batt which thereafter is transported to an autoclaving operation.

The polymer-coated glass fiber batts are treated batchwise in a conventional autoclave to upgrade the physical properties of the batts; specifically, to increase their parting strength. The polymer-coated fiberglass batts are inserted into a pressure chamber into which steam is then introduced at temperatures between about 105° C. and about 140° C. until a working pressure between about 5 and about 40 pounds per square inch absolute is attained. Once the steam has penetrated all portions of the batt, the steam is allowed to remain in contact with the polymer-coated fibers for a period of time sufficient to cause an increase in the parting strength of the so-treated batts. Conveniently, the residence period within the autoclave may vary from about 1 minute to about 20 minutes. Methods for curing aqueous acid aluminum phosphate-coated glass fibers are more fully set forth in U.S. Pat. No. 5,223,336 which is incorporated by reference hereinabove.

Thus, fiberglass insulation having improved parting strength may be prepared.

EXAMPLES

Fiberglass mat is prepared by a rotary process and coated with aqueous acid aluminum phosphate. The coated fiberglass is subjected to the curing conditions set forth in the Table, resulting in the indicated parting strengths, as determined by ASTM C686. The polymer-coated fiberglass batts are then autoclaved utilizing about 107° C. saturated steam for a period of about 10 minutes, resulting in the improved parting strengths as indicated in the Table. It is observed that the autoclaved batts display increased parting strengths.

TABLE

PARTING STRENGTHS OF FIBERGLASS BattS

| | Oven Cure Conditions | Oven Cured Parting Strength grams/gram | Autoclaved Parting Strength grams/gram |
|---|---|---|---|
| Example 1 | 316° C. @ 3 min. | 8 | 12 |
| Example 2 | 370° C. @ 1 min. | 9 | 14 |
| Example 3 | 370° C. @ 2 min. | 3 | 9 |
| Example 4 | 370° C. @ 3 min. | 5 | 9 |
| Example 5 | 427° C. @ 1 min. | 7 | 9 |
| Example 6 | 427° C. @ 3 min. | 8 | 14 |

While certain representative details and embodiments have been set forth for the purpose of illustrating the invention, it will be apparent to those ordinarily skilled in the art that various changes may be made therein, and that the invention may be practiced otherwise than as specifically illustrated and described without departing from its spirit and scope.

What is claimed is:

1. A process for preparing fiberglass insulation, comprising:

forming a mat of glass fibers;

applying to the glass fiber an aqueous acid aluminum phosphate;

curing the aqueous acid aluminum phosphate to form an amorphous aluminum phosphate polymer; and autoclaving the polymer-coated glass fibers.

2. The process for preparing fiberglass insulation according to claim 1, wherein the step of forming the mat of glass fibers comprises a rotary extrusion process.

3. The process for preparing fiberglass insulation according to claim 1, wherein the aqueous acid aluminum phosphate is applied to the glass fibers by spraying during the forming of the mat.

4. The process for preparing fiberglass insulation according to claim 1, wherein the aqueous acid aluminum phosphate comprises a mixture of aluminum oxide, ortho-phosphoric acid, and water.

5. The process for preparing fiberglass insulation according to claim 4, wherein the molar ratio of aluminum oxide to ortho-phosphoric acid in the mixture is less than about 1.

6. The process for preparing fiberglass insulation according to claim 1, wherein the aqueous acid aluminum phosphate is cured at a temperature from about 315° C. to about 425° C.

7. The process for preparing fiberglass insulation according to claim 1, wherein the aqueous acid aluminum phosphate is cured for a period of time from about ½ minute to about 3 minutes.

8. The process for preparing fiberglass insulation according to claim 1, wherein the autoclaving is carried out at a temperature from about 105° C. to about 140° C.

9. The process for preparing fiberglass insulation according to claim 1, wherein the autoclaving is carried out for a period of time from about 1 minute to about 20 minutes.

10. A process for preparing fiberglass insulation, comprising:

forming, by a rotary extrusion process, a mat of glass fibers;

applying to the glass fibers, by a spraying process during the forming step, an aqueous acid aluminum phosphate, comprising a mixture of aluminum oxide, ortho-phosphoric acid, and water, the ratio of aluminum oxide to ortho-phosphoric acid being from about 0.5 to about 0.25;

curing the aqueous acid aluminum phosphate at a temperature from about 375° C. to about 400° C. for a period of time from about ¾ minute to about 1½ minutes to form an amorphous aluminum phosphate polymer; and autoclaving the polymer-coated glass fibers at a temperature from about 105° C. to about 140° C. for a period of time from about 1 minute to about 20 minutes.

11. A fiberglass insulation product prepared by the process of claim 1, with the product exhibiting improved parting strength.

12. The fiberglass insulation product according to claim 11, wherein the fibers have diameters from about 2 microns to about 12 microns.

13. The fiberglass insulation product according to claim 11, wherein the fibers have lengths from about ¼ inch to about 3 inches.

14. The fiberglass insulation product according to claim 11, wherein the polymer is a reaction product of a mixture comprising aluminum oxide, ortho-phosphoric acid, and water.

15. A fiberglass insulation product prepared by the process of claim 10, wherein the fibers have a diameter from about 3 microns to about 8 microns and lengths from about ½ inch to about 1½ inches.

* * * * *